US005387293A

United States Patent [19]

Endo et al.

[11] Patent Number: 5,387,293

[45] Date of Patent: Feb. 7, 1995

[54] COPPER BASE ALLOYS AND TERMINALS USING THE SAME

[75] Inventors: Takayoshi Endo; Kenji Takenouchi, both of Shizuoka; Mikio Nishihata, Tokyo; Toshio Asano, Tokyo; Akira Sugawara, Tokyo, all of Japan

[73] Assignees: Dowa Mining Co., Ltd.; Yazaki Corporation, both of Tokyo; Nihon Bell Parts Co., Ltd., Yachiyo, all of Japan

[21] Appl. No.: 36,489

[22] Filed: Mar. 24, 1993

Related U.S. Application Data

[63] Continuation-in-part of Ser. No. 821,707, Jan. 16, 1992, abandoned.

[30] Foreign Application Priority Data

Jan. 17, 1991 [JP] Japan ..... 3-18337

[51] Int. Cl.[6] ..... C22C 9/02

[52] U.S. Cl. ..... 148/412; 148/414; 420/472; 420/473; 420/485

[58] Field of Search ..... 420/472, 473, 476, 481, 420/485; 148/412, 413, 414

[56] References Cited

U.S. PATENT DOCUMENTS 4,337,089 6/1982 Arita et al. ..... 420/472
4,971,758 11/1990 Suzuki et al. ..... 420/472

FOREIGN PATENT DOCUMENTS 59-6346 1/1984 Japan .
63-37176 7/1988 Japan .
1-316432 12/1989 Japan .
3-6341 1/1991 Japan .

*Primary Examiner*—George Wyszomierski
*Attorney, Agent, or Firm*—Frishauf, Holtz, Goodman & Woodward

[57] ABSTRACT

A copper base alloy for terminals that is of the Cu-Ni-Sn-P or Cu-Ni-Sn-P-Zn system and that has a tensile strength of at least 50 kgf/mm$^2$, a spring limit of at least 40 kgf/mm$^2$, a stress relaxation of not more than 10% and a conductivity of at least 30% IACS is provided. Terminals the spring portion or the entire part of which is produced from that copper base alloy, having an insertion/extraction force of 0.2–3 kgf and a resistance of not more than 3 mΩ at low voltage and current as initial performance, with the added characteristic that the terminals will experience not more than 20% stress relaxation are also provided. The alloy is superior to the conventional bronze, phosphor bronze and Cu-Sn-Fe-P alloys for terminals in terms of tensile strength, spring limits, stress relaxation characteristic and conductivity and, hence, the terminals manufactured from those alloys have higher performance and reliability than the terminals made of the conventional copper base alloys for terminals.

9 Claims, 6 Drawing Sheets

COPPER BASE ALLOYS AND TERMINALS USING THE SAME

This is a continuation-in-part application of U.S. Ser. No. 07/821,707 filed Jan. 16, 1992, now abandoned.

BACKGROUND OF THE INVENTION

This invention relates to copper base alloys, as well as connector terminals that are made of those copper base alloys for use in automobiles and other applications.

Copper base alloys for use in terminals in automobiles and other applications have conventionally been selected from among brass, phosphor bronze and other copper base alloys such as Cu-Sn-Fe-P systems.

In response to the recent advances in electronics technology, connector terminals for use in automobiles and other applications have increasingly been required to satisfy the need for higher packing density, smaller scale, lighter weight and higher reliability. On the other hand, the constant improvement in the engine performance has led to a higher temperature in the engine room. Under these circumstances, there has arisen the need that the copper base alloys for terminals that are used as conductive materials on the engine should have even higher reliability and heat resistance. However, brass that has heretofore been used as an inexpensive copper base alloy for terminals has low electrical conductivity (to take C2600 as an example, its electrical conductivity is 27% IACS); it also has problems with corrosion resistance and stress relaxation characteristics. Further, phosphor bronze has high strength but its electrical conductivity (hereunder simply referred to as "conductivity") is also low (to take C5210 as an example, its conductivity is ca. 12% IACS); in addition, it has problems with stress relaxation characteristic and from an economic viewpoint (high price). Cu-Sn-Fe-P alloys have been developed with a view to solving those problems of brass and phosphor bronze. For example, Cu-2.0 Sn-0.1 Fe-0.03 P has a conductivity of 35% IACS and is superior in strength; however, its stress relaxation characteristic has not been completely satisfactory in view of its use as an alloy for terminals.

For manufacturing highly reliable automotive terminals, it is necessary to use copper base alloys that are superior in strength, spring limits and conductivity and that will cause neither stress relaxation nor corrosion after prolonged use. However, none of the conventional copper base alloys, i.e., brass, phosphor bronze and Cu-Sn-Fe-P alloys, have satisfied those requirements.

A further problem is that the terminals manufactured from the aforementioned copper base alloys reflect the characteristics of those alloys in a straightforward manner. The terminals using brass, phosphor bronze or Cu-Sn-Fe-P alloys do not satisfy the requirements for high conductivity and good stress relaxation characteristics simultaneously, so they will generate heat by themselves, potentially causing various problems including oxidation, plate seperation, stress relaxation, circuit voltage drop, and the softening or deformation of the housing.

SUMMARY OF THE INVENTION

An object, therefore, of the present invention is to provide a copper base alloy for terminals that is superior in all aspects of tensile strength, spring limits, conductivity and stress relaxation characteristics.

Another object of the present invention is to provide a terminal which at least has a spring made of the above-stated alloy and that is superior in resistance at low voltage and current and in stress relaxation characteristic.

A further object of the present invention is to provide a process for the production of a copper base alloy for terminals, which ensures the production of a copper base alloy for terminals that is superior in all aspects of tensile strength, spring limits, conductivity and stress relaxation characteristics.

A still further object of the present invention is to provide a process for the production of a terminal which ensures the production of a terminal which at least has a spring made of the above-stated alloy and that is superior in resistance at low voltage and current and in stress relaxation characteristic.

In order to attain these objects, the present inventors conducted repeated tests and research efforts on Cu-Ni-Sn-P alloys, as well as Cu-Ni-Sn-P-Zn alloys and found that characteristics satisfactory in terms of tensile strength, conductivity and stress relaxation could be attained by selecting appropriate compositions for those alloys. It was also found that terminals with a built-in spring that was produced from those copper base alloys or terminals that were entirely made of those copper base alloys including a spring as an integral part possessed superior characteristics.

DETAILED DESCRIPTION OF THE INVENTION

Figure 1:
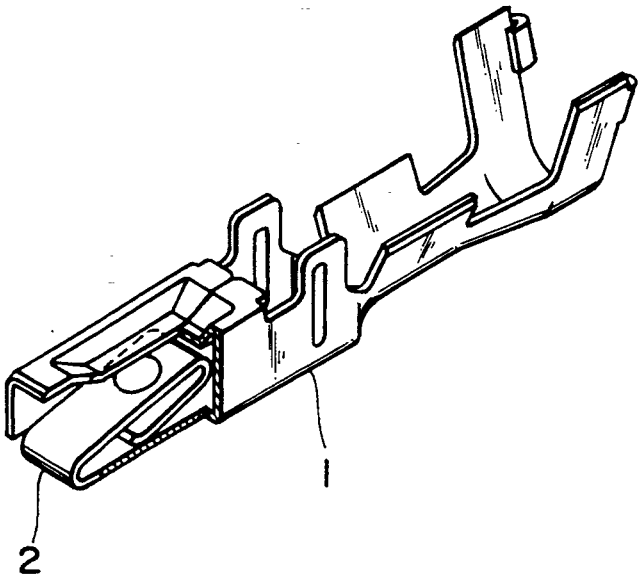
FIG. 1 is a perspective view of an example of the terminal of the present invention.

In its first aspect, the present invention provides a copper base alloy for terminals that consists, on a weight basis, of 0.5–3.0% Ni, preferably 1.0–3.0% Ni, 0.5–2.0% Sn and 0.005–0.20% P, preferably 0.02–0,15% P, with the remainder being Cu and incidental impurities, and that has a tensile strength of at least 50 kgf/mm$^2$, a spring limit of at least 40 kgf/mm$^2$, a stress relaxation of not more than 10% and a conductivity of at least 30% IACS.

In its second aspect, the present invention provides a copper base alloy for terminals that consists, on a weight basis, of 0.5–3.0% Ni, preferably 1.0–3.0% Ni, 0.5–2.0% Sn, 0.005–0.20% P, preferably 0.02–0.15% P and 0.01–2.0% Zn, with the remainder being Cu and incidental impurities, and that has a tensile strength of at least 50 kgf/mm$^2$, a spring limit of at least 40 kgf/mm$^2$, a stress relaxation of not more than 10% and a conductivity of at least 30% IACS.

In its third aspect, the present invention provides a terminal with a built-in spring that is produced from a spring material or a terminal that is entirely made of said spring material including a spring as an integral part, said spring material being produced from a molten copper base alloy that consists, on weight basis, of 0.5–3.0% Ni, preferably 1.0–3.0% Ni, 0.5–2.0% Sn and 0.005–0.20% P, preferably 0.02–0.15% P, with the remainder being Cu and incidental impurities, and that is subsequently worked by hot- and cold-rolling.

In its fourth aspect, the present invention provides a terminal with a built-in spring that is produced from a spring material or a terminal that is entirely made of said material including a spring as an integral part, said spring material being produced from a molten copper base alloy that consists, on a weight basis, of 0.5–3.0% Ni, preferably 1.0–3.0% Ni, 0.5–2.0% Sn, 0.005–0.20% P, preferably 0.02–0.15% P and 0.01–2.0% Zn, with the remainder being Cu and incidental impurities, and that is subsequently worked by hot- and cold-rolling.

In its fifth aspect, the present invention provides a process for producing a copper base alloy for terminals from an ingot of a copper base alloy by repeating the cycles of hot-rolling, cold-rolling and annealing to obtain a sheet of the desired final thickness, characterized in that the ingot is prepared by melting and casting an alloy consisting essentially, on a weight basis, of 1.0–3.0% Ni, 0.02–0.15% P, 0.5–2.0% Sn, and, as an optional component, 0.01–2.0% Zn, with the remainder being Cu and incidental impurities, and with the ratio of weight percentages of Ni to P (Ni/P) being limited within the range of 10–50, that in the cold-rolling after the hot-rolling, the cooling is carried out between the temperature range of not less than 700° C. through not higher than 300° C. at a cooling rate of not less than 60° C./min, that the first cold-rolling among all the cold-rolling stages is carried out at a reduction ratio in cold-rolling stage of not less than 65%, that after said cold-rolling, ageing treatment is carried out at a temperature range of 500°–600° C., preferably around 550° C.,for 5–720 minutes, that the intermediate annealing after the second or later cold-rolling is carried out at a temperature range of 350°–550° C. for 5–720 minutes, that the final cold-rolling is carried out at a reduction ratio in the last cold-rolling stage of not less than 25%, and that the last annealing is carried out at a temperature range of 300°–750° C. for 5–180 seconds under applied tension.

In its sixth aspect, the present invention provides a process for producing a terminal which comprises the steps of melting copper base alloy that consists essentially, on a weight basis, of 1.0–3.0% Ni, 0.02–0.15% P, 0.5–2.0% Sn and, as an optional component, 0.01–2.0% Zn, with the remainder being Cu and incidental impurities and with the ratio of weight percentage of Ni to P (Ni/P) being limited within the range of 10–50, and subsequently working by hot- and cold-rolling into a spring material having a tensile strength of at least 50 kgf/mm$^2$, , a spring limit of at least 40 kgf/mm$^2$, a stress relaxation of not more than 10% and a conductivity of at least 30% IACS, and producing a terminal in the form of an assembly with a built-in spring made from said spring material or in the form of a single body that is entirely made of said spring material including a spring as an integral part.

The actions of the elements contained in the Cu-Ni-Sn-P and Cu-Ni-Sn-P-Zn alloys of the present invention are described below, together with the critically for their compositional ranges.

Nickel (Ni) dissolves in the Cu matrix to provide improved strength, spring limit and stress relaxation characteristics. Further, Ni forms a compound with P, which disperses and precipitates to provide higher conductivity and yet achieve further improvements in strength, spring limit and stress relaxation characteristics. If the Ni content is less than 0.5%, the desired effects will not be achieved; if the Ni content exceeds 3.0%, its effects will be saturated. Therefore, the Ni content is specified to range from 0.5 to 3.0 wt %. However, for the reason given hereinafter, the Ni content should preferably be in the range of 1.0 to 3.0 wt % in view of the additional requirement that the Ni/P ratio should preferably be in the range of 10–50.

Tin (Sn) also dissolves in the Cu matrix to provide improved strength, spring limit and corrosion resistance. If the Sn content is less that 0.5%, the desired effect will not be achieved; if the Sn content exceeds 2.0%, its effect will be saturated. Therefore, the Sn content is specified to range from 0.5 to 2.0 wt %.

Phosphorus (P) not only works as a deoxidizer of the melt but also forms a compound with Ni, which disperses and precipitates to improve not only conductivity but also strength and stress relaxation characteristics. If the P content is less than 0.005%, the desired effects will not be achieved; if the P content exceeds 0.20%, its effects will be saturated. Therefore, the P content is specified to range from 0.005 to 0.20 wt %. However, for the reason given hereinafter, the P content should preferably be in the range of 0.02–0.15 wt % in view of the additional requirement that the Ni/P ratio should preferably be in the range of 10–50.

In the copper base alloys according to the present invention, part of Ni and part of P, both added thereto, form a Ni-P system compound in the form of uniformly dispersed fine precipitates. The formation of these precipitates substantially contributes to the improvement of strength, elasticity, stress relaxation characteristics as well as electrical conductivity. Thus, it is preferred that the ratio of weight percentages of Ni to P (Ni/P) be limited within a certain range. Generally, the Ni/P ratio defined above should be in the range of 5–50. More preferably, the Ni/P ratio should be in the range of 10–50.

Zinc (Zn) that can be added as an auxiliary component has the ability to improve the adhesion of plating under hot conditions. If the Zn content is less than 0.01%, the desired effect will not be achieved; if the Zn content exceeds 2.0%, its effect will be saturated. Therefore, the Zn content is specified to range from 0.01 to 2.0 wt %.

Based on these observations, the present inventors prepared copper base alloys containing Ni, Sn and P as alloying elements and they also prepared copper base alloys containing Zn in addition to those alloying elements. As a result of the intensive studies conducted on the possible effects of interaction between the individual alloying elements, the present inventors found that an alloy consisting, on a weight basis, of 0.5–3.0% Ni, preferably 1.0–3.0% Ni, 0.5–2.0% Sn and 0.005–0.20% P, preferably 0.02–0.15% P, with the remainder being Cu and incidental impurities had the various desired characteristics, thereby achieving the objectives of the present invention. It was also found that a Cu-Ni-Sn-P alloy containing 0.76–2.5% Ni, 0.50–1.75% Sn and 0.02–0.18% P was preferred since it developed the desired characteristics in a more satisfactory way. The most preferred Cu-Ni-Sn-P alloy contained 1.0–2.05% Ni, 0.50–1.50% Sn and 0.03–0.15% P.

As for Cu-Ni-Sn-P-Zn alloys, those which had 0.01–2.0% Zn added to the above-described compositions exhibited the desired characteristics. Preferably, Zn is added in an amount of 0.03–1.0% and, most preferably, Zn is added in an amount of 0.05–0.15%.

The characteristics of the terminals according to the third and fourth aspects of the present invention are described below.

Insertion/extraction force represents the strength of coupling between a male and a female terminal. If this force is excessive, the male terminal cannot be readily inserted into the female terminal. This causes a particular problem with circuits of high packing density because routine assembling operations cannot be accomplished efficiently if the number of terminals to be connected increases. On the other hand, if the insertion/extraction force is too weak, the contact load is so small that an oxide film coat will easily form on account of such factors as vibrations and the contact resistance is too instable to insure satisfactory electrical reliability for connectors.

Under the circumstances, the initial insertion/extraction force of the terminal is desirably from 0.2 to 3 kgf and, to this end, the terminal material to be used must have a tensile strength of at least 50 kgf/mm$^2$, a spring limit of at least 40 kgf/mm$^2$ and a stress relaxation of not more than 10%.

The initial resistance at low voltage and current is desirably small, preferably not more than 3 mΩ. The value of contact electric resistance is dependent primarily on how much the contact load on the coupling will decrease due to heat cycles. However, the stress relaxation caused by spontaneous heat generation from the material, as well as the stress relaxation caused by the effects of temperature in the automobile's engine room or around the exhaust system will also reduce the contact load, which eventually leads to a higher contact electric resistance.

To avoid this problem, the terminal material itself must not undergo stress relaxation greater than 10% upon standing at 150° C. for 1,000 hrs. and it is also required to have a tensile strength of at least 50 kgf/mm$^2$ and a spring limit of at least 40 kgf/mm$^2$. Preferably the material satisfies the additional requirement for a conductivity of at least 30% IACS, with the stress relaxation after working into a spring being preferably not more than 20%.

The following examples are provided for the purpose of further illustrating the present invention.

EXAMPLE 1

Alloys having the compositions shown in Table 1 were melted in a high-frequency melting furnace and hot-rolled at 850° C. to a thickness of 5.0 mm. The surface of each slab was scalped to a thickness of 4.8 mm and by subsequent repetition of cold-rolling operations and heat treatments, sheets having a thickness of 0.2 mm were obtained (final reduction ratio: 67%).

The tensile strength, elongation and spring limit of each sheet were measured; at the same time, the bending and stress relaxation characteristics of each sheet were investigated. The results are shown in Table 1 in comparison with those on conventionally used brass, phosphor bronze and Cu-Sn-P-Fe alloy.

The measurements of tensile strength, conductivity and spring limit were in accordance with JIS Z 2241, JIS H 0505 and JIS H 3130, respectively.

The bending characteristic of each sheet was evaluated by a 90° W bend test, in which according to CES-M0002-6 the sample was subjected to 90° W bend with a tool of R=0.1 mm and the surface state of the center ridge was evaluated by the following criteria: X, cracking occurred; Δ, wrinkles occured; O, good results. The bending axis was set to be parallel to the rolling direction ("Bad Way" bending).

In the Stress relaxation test, the test piece was bent in an arched way such that a stress of 40 kgf/mm$^2$ would develop in the central part and the residual bend that remained after holding at 150° C. for 1,000 hrs. was calculated as "stress relaxation" by the following formula:

$$\text{Stress relaxation (\%)} = \{(L_1 - L_2)/(L_1 - L_0)\} \times 100$$

where $L_0$: the length of the tool (mm);

$L_1$: the initial length of the sample (mm)

$L_2$: the horizontal distance between the ends of the sample after the treatment (mm).

As Table 1 shows, the alloy sample Nos. 1–4 prepared in accordance with the present invention had a tensile strength of at least 50 kgf/mm$_2$, a spring limit of at least 40 kgf/mm$^2$ and a conductivity of at least 30%, and their bending characteristic was also satisfactory. In addition, those samples had superior stress relaxation characteristic (≦10%). It can therefore be concluded that the copper base alloys of the present invention are very advantageous for use in terminals in automobiles and other applications.

TABLE 1

| Sample No. | Chemical Composition (wt %) Ni | Sn | P | Zn | Fe | Tensile Strength (kgf/mm$^2$) | Conductivity (% IACS) | Spring Limit (kgf/mm$^2$) | 90° W Bend | Stress Relaxation (%) |
|---|---|---|---|---|---|---|---|---|---|---|
| Invention | | | | | | | | | | |
| 1 | 1.07 | 0.91 | 0.05 | — | — | 58.4 | 40.1 | 47.2 | ○ | 5.2 |
| 2 | 1.10 | 1.48 | 0.05 | — | — | 63.2 | 34.7 | 52.3 | ○ | 6.1 |
| 3 | 2.03 | 1.06 | 0.10 | — | — | 60.7 | 32.7 | 49.1 | ○ | 4.4 |
| 4 | 1.51 | 0.52 | 0.05 | 0.10 | — | 57.8 | 40.8 | 46.4 | ○ | 4.4 |
| Comparison | | | | | | | | | | |
| 5 | — | 8.21 | 0.19 | — | — | 66.1 | 11.6 | 49.8 | Δ | 20.2 |
| 6 | — | — | — | 29.7 | — | 55.3 | 26.9 | 27.1 | Δ | 35.2 |

TABLE 1-continued

| Sample No. | Chemical Composition (wt %) Ni | Sn | P | Zn | Fe | Tensile Strength (kgf/mm²) | Conductivity (% IACS) | Spring Limit (kgf/mm²) | 90° W Bend | Stress Relaxation (%) |
|---|---|---|---|---|---|---|---|---|---|---|
| 7 | — | 2.0 | 0.03 | — | 0.1 | 58.1 | 34.1 | 49.6 | ∘ | 19.6 |

EXAMPLE 2

The characteristics of terminals using the copper base alloy of the present invention are described below specifically with reference to an example.

In order to evaluate the performance as a terminal, sheets of the alloys of the present invention were press formed and checked for the most important objective of the present invention, i.e., stress relaxation characteristic.

The alloys prepared in accordance with the present invention were press formed into female terminals shown by 1 in FIG. 1, each being equipped with a spring 2. The terminals were subjected to a post-heat treatment in order to provide a good spring property. The heat treatment consisted of heating at 180° C. for 30 min. in order to prevent excessive surface deterioration so that Sn plating could subsequently be performed as a surface treatment of the terminals. The so treated terminals were subjected to a test for evaluating their stress relaxation characteristic. For comparison with prior art versions, female terminals made from a Cu-Sn-Fe-P alloy and a brass material were also subjected to a heat treatment under the same conditions and, thereafter, a performance test was conducted in the same manner.

The terminals had an initial insertion/extraction force ranging from 0.5 to 0.6 kgf and their initial resistance at low voltage and current ranged from 1.5 to 2.0 mΩ.

The stress relaxation characteristic of the terminals was tested by the following method: the male terminal was fitted into the female terminal and the assembly was subjected to a heat resistance test and the contact load was measured both before and after the test. In the heat resistance test, the specimens were exposed to 120° C. for 300 hrs. The percent stress relaxation was calculated by the following formula:

$$\text{Stress relaxation (\%)} = \{(F_1 - F_2)/F_1\} \times 100$$

where $F_1$: the initial contact load (gf);

$F_2$: the contact load after the test (gf).

Figure 3:
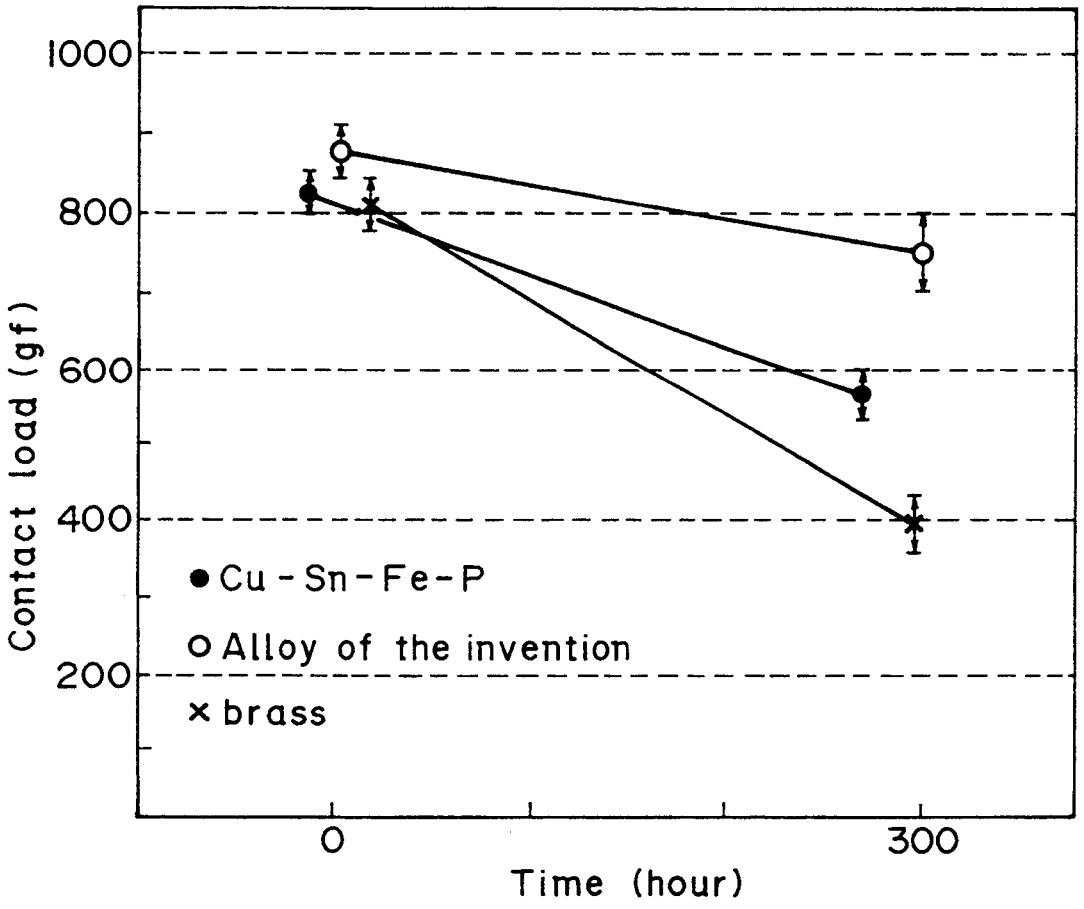
FIG. 3 is a graph showing the stress relaxation characteristic of the terminal of the present invention and a prior art terminal.

The test results are shown in FIG. 3. The female terminal made of the prior art Cu-Sn-Fe-P alloy experienced a greater drop in contact load than the female terminal made of the copper base alloy of the present invention and the stress relaxation of the former terminal was ca. 30%. The brass terminal experienced ca. 50% stress relaxation. On the other hand, the stress relaxation of the female terminal made of the copper base alloy within the scope of the present invention was ca. 12%, which satisfied the requirement for the stress relaxation of no more than 20% and hence was superior to the comparative terminals.

Figure 4:
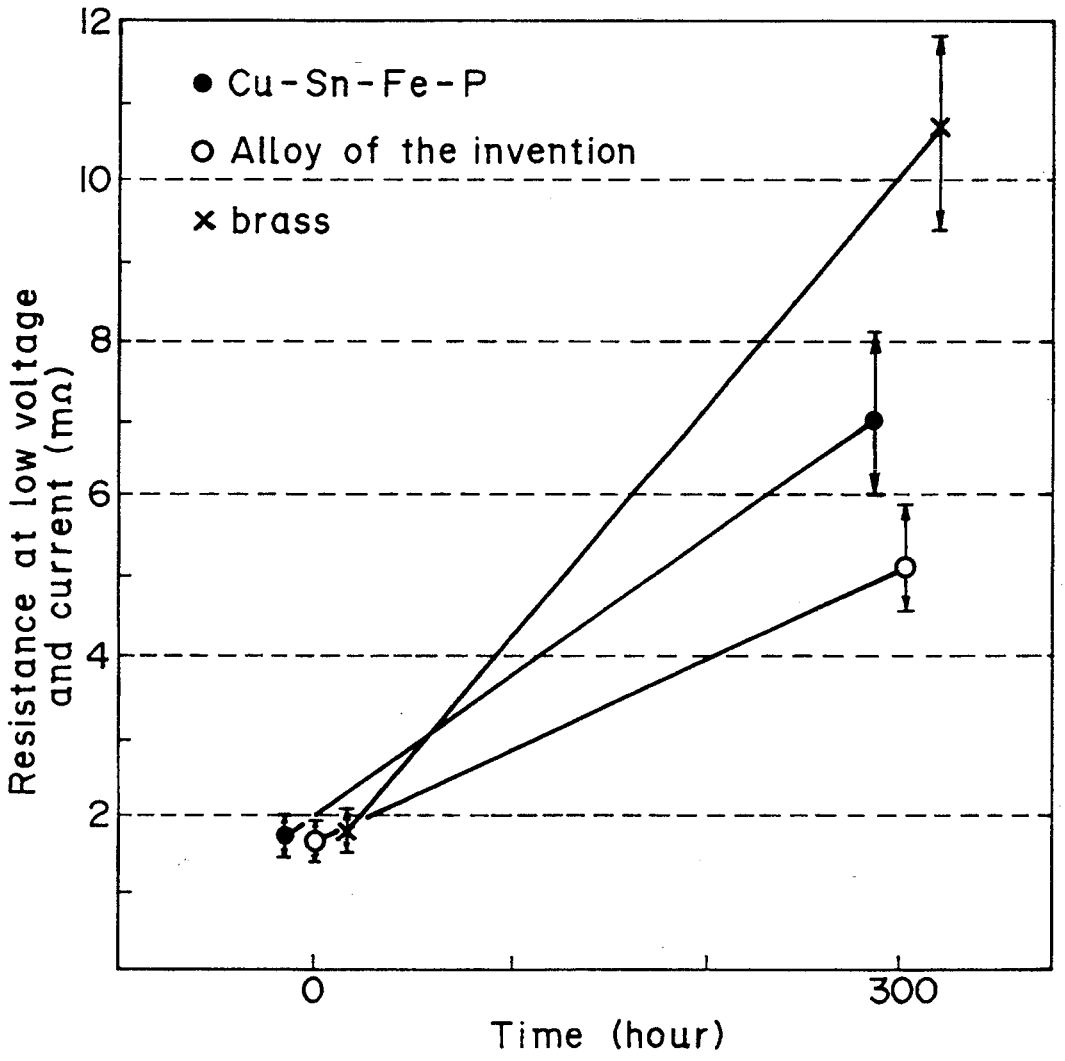
FIG. 4 is a graph showing the electrical characteristic of the terminal of the present invention and a prior art terminal.
Figure 5:
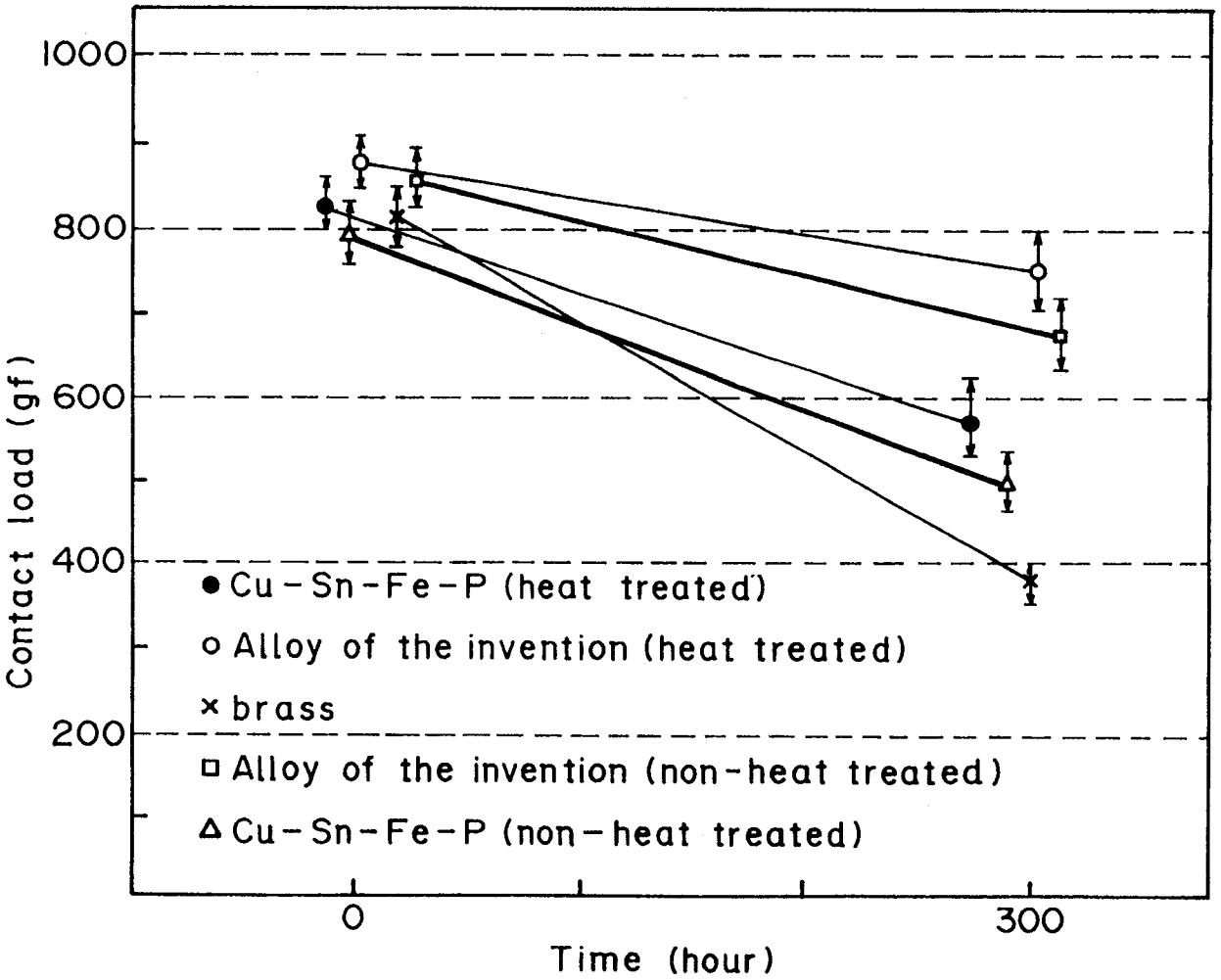
FIG. 5 is a graph modifying FIG. 3 and showing the comparison between the heat-treated and non-heat-treated products with respect to the stress relaxation characteristic of the terminal of the present invention and a prior art terminal.
Figure 6:
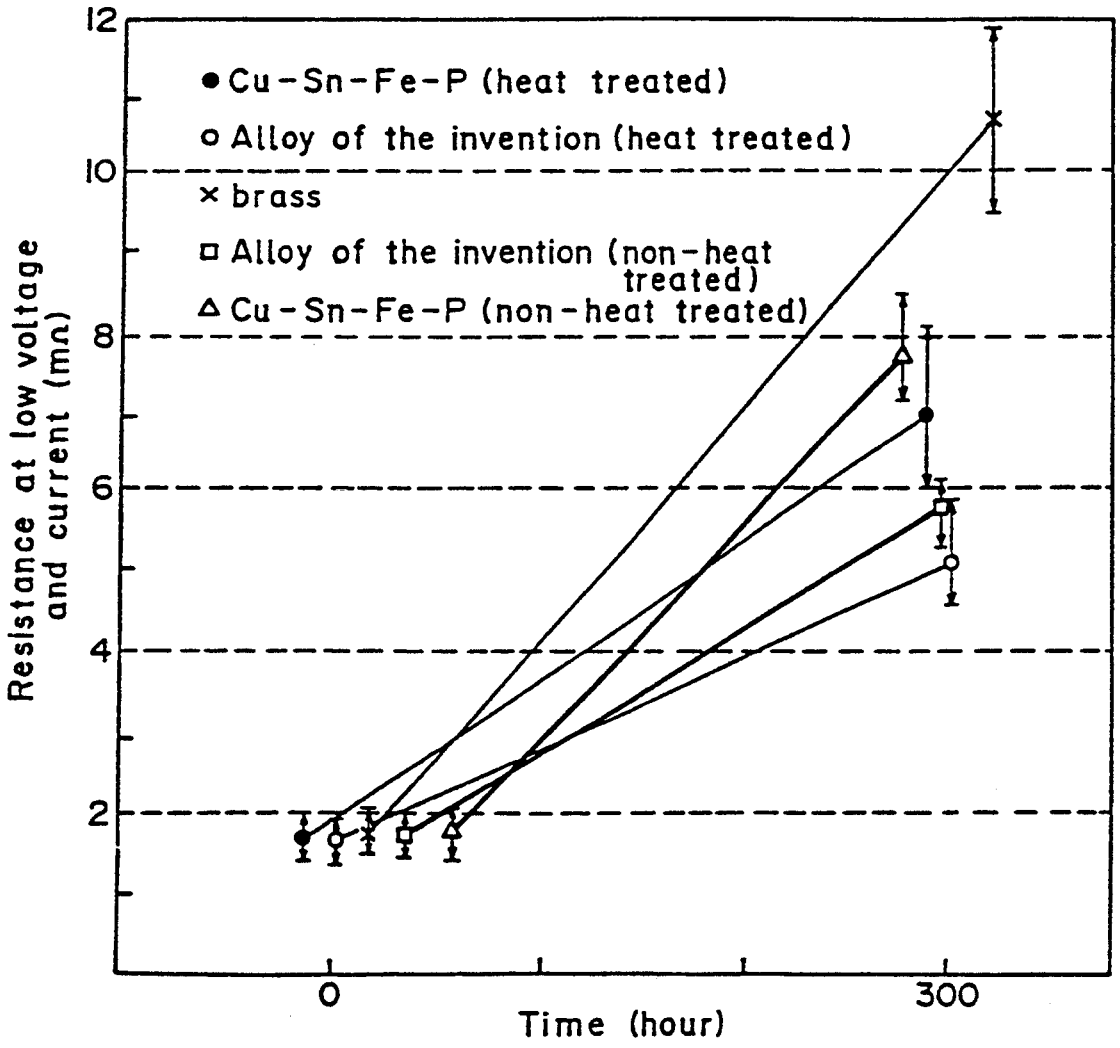
FIG. 6 is a graph modifying FIG. 4 and showing the comparison between the heat-treated and non-heat-treated products with respect to the electrical characteristic of the terminal of the present invention and a prior art terminal.

The stress relaxation of the non-heat treated terminal was ca. 20%. In the case of the heat treated terminal, the stress relaxation was substantially smaller. The comparison is given in FIG. 5. The same samples were subjected to a test for evaluating their electrical performance by leaving them to stand at 120° C. for 300 hrs. and the resistance at low voltage and current was measured both before and after the test. The results are shown in FIG. 4, from which one can clearly see that the copper base alloy of the present invention was also superior to the conventional Cu-Sn-Fe-P alloy and brass in terms of electrical performance. The stability of resistance at low voltage and current could be improved by heat treatment. The comparison is given in FIG. 6.

Figure 2:
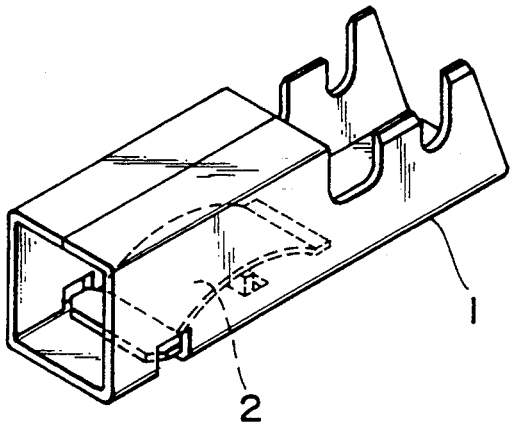
FIG. 2 is a perspective view of another example of the terminal of the present invention.

Female terminals shown by 1 in FIG. 2 were shaped that had a built-in spring 2 made from the copper base alloy of the present invention. The terminals were subjected to the same tests as described above and they performed as well as the terminals depicted in FIG. 1.

The foregoing results demonstrate that the terminals using the copper base alloy of the present invention excel in performance as automotive terminals. It should, however, be noted here that the copper base alloy of the present invention and the terminal made of that alloy are also applicable, with equal effectiveness, to aircraft, ships, etc.

The copper base alloy of the present invention is superior not only in tensile strength, spring limits and electric conductivity but also in stress relaxation characteristic. Further, terminals that are made of that alloy and that have a built-in spring have small resistance at low voltage and current and excel in stress relaxation characteristic, thereby insuring significant industrial advantages.

Thus, according to the present invention, there is provided a copper base alloy for terminals that has a conductivity of at least 30% IACS, that has high tensile strength and spring limits, and that yet experiences not more than 10% stress relaxation. Further, terminals with a built-in spring that is produced from said copper base alloy or terminals that are entirely made of said copper base alloy including a spring have good initial characteristics as evidenced by an insertion/extraction force of 0.2–3 kgf, a resistance of not more than 3 mΩ at low voltage and current, and stress relaxation of not more than 20%.

As a result of further investigation, we have found that in the production of the alloy or the terminal of the present invention the weight percentage ratio of Ni to P (Ni/P) defined above has more important meaning than we first estimated. This will be shown more clearly by Example 3 given hereinbelow.

When the ratio of Ni to P (Ni/P) is in the range of 10 to 50, alloys having well balanced characteristic properties suitable for terminal material are obtained. In this connection, the preferred compositions of the alloys of the present invention are determined as follows by a number of experiments.

We have also found that in order to easily obtain an alloy which satisfies the requirement of the Ni to P ratio (Ni/P) in the range of 10–50, the alloy of the present invention should preferably consist, on a weight basis, of 1.0–3.0% Ni, 0.02–0.15% P, 0.5–2.0% Sn, and optionally, 0.01–2.0% Zn, with the balance being Cu and incidental impurities.

EXAMPLE 3

Alloys having the compositions shown in Table 2 were melted in a high-frequency melting furnace and cast into an ingot 20 mm thick 50 mm wide 250 mm long ($20^t \times 50^w \times 250^l$) and ca. 2.3 kg in weight. During the stages of melting and casting, an argon gas was used to control the operational atmosphere so that the oxidation of the alloys may be avoided as much as possible. After the ingot was cut into a piece of a size $20^t 50^w 150^l$ and ca. 1.3 kg in weight, the piece was uniformly heated at a temperature of 850° C. for 60 minutes before it was hot-rolled to a thickness of 5.0 mm. In the course of rolling, the ingot was re-heated to a temperature of 850° C. When the last rolling was finished, the rolled product was cooled in water, with the starting temperature being 750° C. The cooling rate in this stage was well exceeding 60° C./min or 1° C./sec within the cooling temperature range of 700° C. to 300° C. In each of the above mentioned heat treatment stages, the operational atmosphere was controlled by the use of an argon gas.

The both surfaces of each hot-rolled sheet were scalped by 0.1 mm to make the sheet 4.8 mm thick. The resulting sheet was subjected to the first cold-rolling to obtain a sheet 1.5 mm thick. This corresponded to the reduction ratio of 69%. Then, the sheet was annealed at 550° C. for 120 minutes. The sheet was subjected to further cold-rolling into a thickness of 0.6 mm, followed by being annealed at 480° C. for 60 minutes. Then the sheet was subjected to the final cold-rolling to obtain a sheet having a thickness of 0.2 mm (final reduction ratio: 67%).

The resulting cold-rolled sheet was subjected to tension anneal treatment at 420° C. for 20 seconds under applied tension of 10 kgf/mm$^2$.

Samples of Nos. 19, 20 and 21 given in Table 2 are not those obtained by the sequence of treatments mentioned above but those prepared from commercially available copper based alloys, i.e., phosphor bronze for spring, C5210H (No.19), Type I brass, C2600EH (No.20) and Cu-Sn-Fe-P alloy, Type H (No.21).

With respect to each sample as set forth in Table 2, the tensile strength, conductivity and spring limit were determined, and also 90° W bent test, stress relaxation test, migration test and stress corrosion cracking test were effected. The results of these tests are shown in Table 3.

The measurements of the tensile strength, conductivity and spring limit were conducted according to JIS Z 2241, JIS H 0505 and JIS H 3130, respectively.

Stress corrosion cracking test was conducted as follows.

The test piece was bent in an arched way such that a stress of 40 kgf/mm$^2$ would develop in the central part and was placed in a desiccator at the bottom of which a small amount of an aqueous 12.5% ammonium solution was given. The test piece was placed on the porous plate in the desiccator and was disposed to the atmosphere containing gaseous ammonia until cracking developed in the test piece. The length of time required to develop a cracking in the test piece was measured and anti-stress corrosion cracking property was evaluated by the following criteria:

x: cracking develops within 10 hours, cracking develops in more than 10 hours but less than 100 hours, no cracking develops even after 100 hours.

Migration test was carried out as follows.

Figure 7:
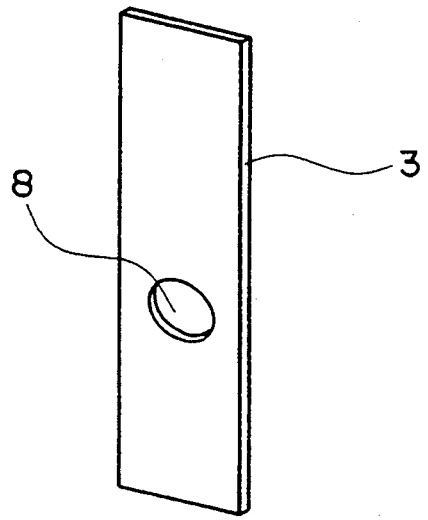
FIG. 7 is a perspective view of a plate made of an ABS resin having a circular opening in the central area which is used for fixing a pair of test pieces for the migration test.
Figure 8:
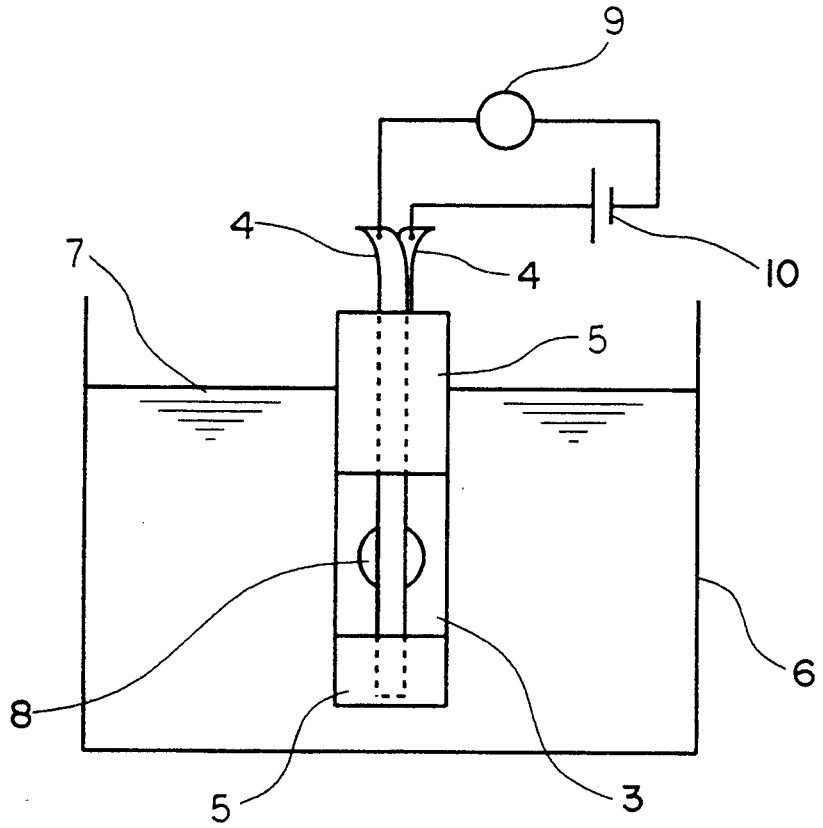
FIG. 8 is an illustrative view of an apparatus for carrying out the migration test.

A plate 3 (1 mm$^{(t)}$×15 mm$^{(w)}$×72 mm$^{(l)}$) made of ABS resin and having in the central area thereof a circular opening 8 as shown in FIG. 7 was prepared. This plate was sandwiched by a pair of test pieces (each 0.2 mm$^{(t)}$×5 mm$^{(w)}$×80 mm$^{(l)}$) and the resulting assembly was joined together by winding around it at both upper and lower portions with separate pieces of Teflon tape 5. Then, the fixed assembly was held in a testing vessel (or beaker) 6 filled with tap water 7 as shown in FIG. 8. Fourteen volt of direct current voltage was applied to the test pieces in the manner as shown in FIG. 8, in which 3 represents a plate made of ABS resin, 4 represents a test piece, 5 represents a Teflon tape, 6 represents a testing vessel, 7 represents tap water, 8 represents an opening, 9 represents an ammeter and 10 represents a DC power source. The migration characteristic of a test piece was evaluated by measuring maximum leakage current after 8 hours' application of 14 V DC voltage. In the evaluation of the migration characteristic, symbol x represents that "short" occured by less than 8 hours' application of the voltage.

The results given in Table 3 clearly show the following matters.

1) The alloys according to the present invention represented by the samples of Nos. 8 through 11 and 22 exhibit a well balanced relationship of one another among improved tensile strength (57 kgf/mm$^2$ or more), improved conductivity (32% IACS or more) and improved spring limit (46 kgf/mm$^2$ or more) as well as they show excellence in any of the properties inclusive of bending workability, anti-stress relaxation characteristic (7% or less), anti-migration property (0.4 A or less) and anti-stress corrosion cracking characteristic. These results clearly show that the alloy of the present invention is the one that is most suitable as a material for prepareing therefrom a terminal or a connector. Also, in the process of producing the alloy of the present invention, one may encounter almost no significant problems in any of the stages inclusive of melting, casting, hot-rolling, cold-rolling, heat treatment and pickling, and the process can be carried out with a good yield.

In contrast, the alloy of Sample No.12 is outside the scope of the present invention, because it contains less amount of P than is defined in the present invention and also the Ni/P ratio thereof is higher than is defined in the present invention. The test results with respect to this alloy as given in Table 3 show that this alloy is inferior to the alloy of the present invention in the tensile strength, spring limit and stress relaxation.

TABLE 2

| Sample No. | Chemical Composition (wt %) | | | | | |
|---|---|---|---|---|---|---|
| | Ni | P | Ni/P | Sn | Zn | Fe |
| Invention | | | | | | |
| 8 | 1.07 | 0.053 | 20.2 | 0.91 | — | — |
| 9 | 1.10 | 0.054 | 20.4 | 1.48 | — | — |
| 10 | 2.03 | 0.102 | 19.9 | 1.06 | — | — |
| 11 | 1.51 | 0.052 | 29.0 | 0.52 | 0.10 | — |
| Comparison | | | | | | |
| 12 | 1.14 | 0.012 | 95.0 | 0.87 | — | — |
| 13 | 1.08 | 0.220 | 4.9 | 1.10 | — | — |
| 14 | 0.55 | 0.031 | 15.2 | 0.61 | — | — |
| 15 | 0.87 | 0.013 | 66.9 | 0.69 | 0.009 | — |
| 16 | 0.63 | 0.154 | 4.1 | 1.79 | — | — |
| 17 | 3.10 | 0.092 | 33.7 | 0.52 | — | — |
| 18 | 1.03 | 0.051 | 20.2 | 0.42 | — | — |
| Commercially Available Products | | | | | | |
| 19 | — | 0.19 | — | 8.21 | — | — |

TABLE 2-continued

| Sample No. | Chemical Composition (wt %) | | | | | |
|---|---|---|---|---|---|---|
| | Ni | P | Ni/P | Sn | Zn | Fe |
| 20 | — | — | — | — | 29.7 | — |
| 21 | — | 0.031 | 2.02 | — | 0.10 | |
| Invention | | | | | | |
| 22 | 1.06 | 0.079 | 13.4 | 0.81 | 0.14 | — |

TABLE 3

| Sample No. | Tensile Strength (kgf/mm²) | Conductivity (% IACS) | Spring Limit (kgf/mm²) | 90° W Bend | Stress Relaxation (%) | Max. Leak Current (A) | Anti-Stress Corrosion |
|---|---|---|---|---|---|---|---|
| Invention | | | | | | | |
| 8 | 58.4 | 40.1 | 47.2 | ○ | 5.2 | 0.31 | ○ |
| 9 | 63.2 | 34.7 | 52.3 | ○ | 6.1 | 0.39 | ○ |
| 10 | 60.7 | 32.7 | 49.1 | ○ | 4.4 | 0.33 | ○ |
| 11 | 57.8 | 40.8 | 46.4 | ○ | 4.4 | 0.29 | ○ |
| Comparison | | | | | | | |
| 12 | 55.1 | 38.9 | 43.3 | ○ | 7.0 | 0.31 | ○ |
| 13 | 62.5 | 40.4 | 50.8 | Δ | 7.1 | 0.38 | ○ |
| 14 | 45.1 | 52.8 | 38.1 | ○ | 10.4 | 0.44 | ○ |
| 15 | 50.2 | 53.0 | 39.2 | ○ | 10.7 | 0.46 | ○ |
| 16 | 61.1 | 38.0 | 47.7 | Δ | 7.4 | 0.48 | ○ |
| 17 | 59.1 | 29.4 | 48.3 | X | 6.0 | 0.24 | ○ |
| 18 | 53.8 | 50.1 | 41.7 | ○ | 6.3 | 0.31 | ○ |
| Commercially Available Products | | | | | | | |
| 19 | 66.1 | 11.6 | 49.8 | Δ | 20.2 | X | Δ |
| 20 | 55.3 | 26.9 | 27.1 | Δ | 35.2 | 0.19 | X |
| 21 | 58.1 | 34.1 | 49.8 | ○ | 19.6 | X | Δ |
| Invention | | | | | | | |
| 22 | 61.9 | 38.0 | 48.2 | ○ | 5.3 | 0.32 | ○ |

As is obvious from the results shown in Table 3, the alloy of Sample No. 13 (comparative), which is the alloy outside the scope of the present invention because the P content is higher and the ratio of Ni to P (Ni/P) is lower than defined in the present invention, exhibits poorer bending workability and poorer stress relaxation. This can be explained as follows.

Due to the presence of too much P and therefor the Ni/P ratio being low, excessive precipitation of Ni-P compounds has occurred. This seems to have caused the decrease in the bending workability and the stress relaxation characteristics. In addition, when the alloy of Sample No. 13 was used, the molten alloy showed poor fluidity in the stage of casting and the surface of ingot was not good. This alloy was not free from the problems of side-cracking in the stage of hot-rolling and of removing the film during the stage of pickling after the heat treatment stage. All of these problems suggested inferiority of this comparative alloy inclusive of poorer yield, extended treating time and increased production cost as compared with the alloy of the present invention.

The alloy of Sample No. 14 is also the one outside the scope of the present invention, because it contains less Ni than is defined in the present invention. As shown in Table 3, this alloy showed poorer tensile strength, poorer elasticity, poorer anti-stress relaxation, and poorer anti-migration characteristics than the alloy of the present invention.

It has been recognized by a number of experiments that the Ni content should preferably be 1.0% by weight or more, together with corresponding suitable amounts of P and Sn in order to obtain an alloy having satisfactory values in any of the tensile strength, elasticity, anti-stress relaxation and anti-migration.

The alloy of Sample No. 15 is also the one outside the scope of the present invention, because it contains less Ni and less P and the Ni/P ratio is excessively large as compared with the alloy of the present invention. Thus, the alloy is inferior to the alloy of the present invention in any of the tensile strength, elasticity, anti-stress relaxation and anti-migration characteristics.

The alloy of Sample No. 16 is also the one outside the scope of the present invention, because it contains less Ni, more P and has the too small Ni/P ratio as compared with the alloy of the present invention. Thus, it does not show satisfactory characteristics as is obvious from Table 3.

The alloy of Sample No. 17 is also the one outside the scope of the present invention, because it contains more Ni, than defined in the present invention. This alloy shows inferior characteristics particularly in conductivity and bending workability. This shows that the addition of excessive amount of Ni causes the formation of solid-solution which contains too much Ni in Cu matrix. As a result, the conductivity of the alloy decreases significantly. Also, the bending workability becomes poor.

The alloy of Sample No. 18 is also the one outside the scope of the present invention, because the Sn content is less than defined in the present invention. As is obvious from Table 3, this alloy shows poorer tensile strength and poorer elasticity as compared with the alloy of the present invention. This shows that if the Sn content is less than that defined in the present invention, satisfactory tensile strength and elasticity cannot be obtained, even if all the other factors such as the Ni and P contents and the Ni/P ratio are satisfied.

Sample Nos. 19 through 21 are some examples of the comercially available alloy products. It is obvious from Table 3 that they are not always satisfactory for preparing terminals therefrom.

What is claimed is:

1. In a connector terminal, wherein the improvement comprises said connector terminal being made of a plate material of a copper alloy that consists essentially, on a weight basis, of 1.10% Ni, 0.05% P and 1.48% Sn with the remainder being Cu and incidental impurities, and that has a tensile strength of at least 50 kgf/mm², a spring limit of at least 40 kgf/mm$^2$, a stress relaxation of not more than 10% and an electrical conductivity of at least 30% IACS, said copper alloy having uniformly dispersed therein fine particles of a Ni-P compound.

2. In a connector terminal, wherein the improvement comprises said connector terminal being made of a plate material of a copper alloy that consists essentially, on a weight basis, of 1.10% Ni, 0.054% P, 1.48% Sn, with the balance being Cu and incidental impurities, and that has a tensile strength of at least 50 kgf/mm$^2$, a spring limit of at least 40 kgf/mm$^2$, a stress relaxation of not more than 10% and an electrical conductivity of at least 30% IACS, said copper alloy having uniformly dispersed therein fine particles of a Ni-P compound.

3. The terminal according to claim 2, having an initial insertion/extraction force of 0.2–3 kgf and initial resistance at low voltage and current of not more than 3 mΩ, with a stress relaxation after working the alloy into a spring being not more than 20%.

4. A terminal with a built-in spring that is produced from a spring material or a terminal that is entirely made of said spring material including a spring as an integral part, said spring material having been produced from a molten copper alloy that consists essentially, on a weight basis, of 1.10% Ni, 0.054% P and 1.48% Sn with the balance being Cu and incidental impurities, and that has been subsequently worked by hot-rolling and cold-rolling, said copper alloy having uniformly dispersed therein fine particles of a Ni-P compound.

5. The terminal according to claim 4, having an initial insertion/extraction force of 0.2–3 kgf and an initial resistance at low voltage and current of not more than 3 mΩ with an stress relaxation after working the alloy into a spring being not more than 20%.

6. A terminal with a built-in spring that is produced from a spring material or a terminal that is entirely made of said spring material including a spring as an integral part, said spring material having been produced from a molten copper alloy that consists essentially, on a weight basis, of 1.10% Ni, 1.48% Sn and 0.05% P, with the balance being Cu and incidental impurities, and that has been subsequently worked by hot-rolling and cold-rolling, said copper alloy having uniformly dispersed therein fine particles of a Ni-P compound.

7. The terminal according to claim 6, having an initial insertion/extraction force of 0.2–3 kgf and an initial resistance at low voltage and current of not more than 3 mΩ, with a stress relaxation after working the alloy into a spring being not more than 20%.

8. A copper alloy which consists essentially of 1.10 wt. % Ni, 1.48 wt.% Sn and 0.05 wt. % P, with the remainder being Cu and incidental impurities, said alloy having a tensile strength of at least 50 kgf/mm$^2$, a spring limit of at least 40 kgf/mm$^2$, a stress relaxation of not more than 10% and an electrical conductivity of at least 30% IACS, said copper alloy having uniformly dispersed therein fine particles of a Ni-P compound.

9. A copper alloy which consists essentially of 1.10 wt. % Ni, 1.48 wt. % Sn and 0.054 wt. % P, with the remainder being Cu and incidental impurities, said alloy having a tensile strength of at least 50 kgf/mm$^2$, a spring limit of at least 40 kgf/mm$^2$, a stress relaxation of not more than 10% and an electrical conductivity of at least 30% IACS, said copper having uniformly dispersed therein fine particles of a Ni-P compound.

* * * * *